US009993711B2

(12) United States Patent
Moya Saez et al.

(10) Patent No.: US 9,993,711 B2
(45) Date of Patent: Jun. 12, 2018

(54) ROLLER TABLE HAVING A FOLDING STRUCTURE

(71) Applicants: Juan Moya Saez, Barcelona (ES); Jordi Moya Saez, Barcelona (ES)

(72) Inventors: Juan Moya Saez, Barcelona (ES); Jordi Moya Saez, Barcelona (ES)

( * ) Notice: Subject to any disclaimer, the term of this patent is extended or adjusted under 35 U.S.C. 154(b) by 0 days. days.

(21) Appl. No.: 14/650,362

(22) PCT Filed: Nov. 19, 2013

(86) PCT No.: PCT/ES2013/000256
§ 371 (c)(1),
(2) Date: Jun. 8, 2015

(87) PCT Pub. No.: WO2014/087029
PCT Pub. Date: Jun. 12, 2014

(65) Prior Publication Data

US 2015/0314184 A1 Nov. 5, 2015

(30) Foreign Application Priority Data

Dec. 7, 2012 (ES) ..... 201231311 U

(51) Int. Cl.
*A63B 5/11* (2006.01)
*A63B 69/16* (2006.01)
(Continued)

(52) U.S. Cl.
CPC ..... *A63B 69/16* (2013.01); *A63B 22/02* (2013.01); *A63B 22/16* (2013.01);
(Continued)

(58) Field of Classification Search
CPC ..... A63B 22/02; A63B 2225/09; A63B 69/16; A63B 2210/00; A63B 2210/50;
(Continued)

(56) References Cited

U.S. PATENT DOCUMENTS 581,835 A * 5/1897 Sturgis ..... A63B 69/16
482/61
2,430,714 A * 11/1947 Geer ..... A62B 1/22
160/351
(Continued)

FOREIGN PATENT DOCUMENTS

DE 2900483 A1 * 7/1980 ..... A63B 69/16
ES 1046894 U * 2/2001
(Continued)

OTHER PUBLICATIONS

DE2900483A1 Abstract and Specification ProQuest Dialog English Translation Oct. 1, 2016.*

*Primary Examiner* — Nyca T Nguyen
(74) *Attorney, Agent, or Firm* — Avery N. Goldstein; Blue Filament Law, PLLC

(57) ABSTRACT

A folding structure (2), is provided to which one or more rollers (3) are coupled, which is constituted by an articulated one-piece construction, formed of straight sections (2*a*, 2*b*) joined together with articulated joints that rotate around a vertical axis (4) and movement of the sections on the horizontal plane, and hinged joints that rotate around a horizontal axis (5) and movement of the sections on the vertical plane. In a use position, it has a rectangular frame shape, while in a folded position it forms an elongated and flat compact block. The upper part of the structure (2) has recesses (8) with protruding nipples (9), suitable for being inserted into holes (10) made on the ends (3*a*) of the roller (3) axis; while dampers (11) are disposed in the lower part. There is a joint that rotates around a vertical axis (4), and another hinged joint that rotates around a horizontal axis (5).

7 Claims, 3 Drawing Sheets

(51) Int. Cl.
*A63B 22/02* (2006.01)
*A63B 22/16* (2006.01)
*A63B 24/00* (2006.01)

(52) U.S. Cl.
CPC ..... *A63B 24/0084* (2013.01); *A63B 2069/167* (2013.01); *A63B 2210/50* (2013.01); *A63B 2220/30* (2013.01); *A63B 2225/09* (2013.01)

(58) Field of Classification Search
CPC ..... A63B 2210/52; A63B 2210/56; A63B 23/0476; A63B 2069/161–2069/168
See application file for complete search history.

(56) References Cited

U.S. PATENT DOCUMENTS 3,871,648 A * 3/1975 Maurer, III ..... A63B 69/16 434/61
D280,225 S * 8/1985 Eagle ..... D21/664
4,580,983 A * 4/1986 Cassini ..... A63B 22/16 280/293
4,757,987 A * 7/1988 Allemand ..... A63B 22/02 482/54
5,397,285 A * 3/1995 Haan ..... A63B 21/015 482/110
6,830,540 B2 * 12/2004 Watterson ..... A63B 22/0023 482/51
6,857,992 B1 * 2/2005 Kolda ..... A63B 21/0051 482/61
7,780,578 B2 * 8/2010 Packham ..... A63B 22/02 482/4
2006/0217237 A1 * 9/2006 Rhodes ..... A63B 21/225 482/61
2008/0280734 A1 * 11/2008 Dickie ..... A63B 22/0023 482/54
2010/0204024 A1 * 8/2010 Mills ..... A63B 21/00069 482/130
2012/0184399 A1 * 7/2012 Reeves ..... F16B 7/042 473/478

FOREIGN PATENT DOCUMENTS

FR 607313 A * 6/1926 ..... A63B 69/16
FR 1176944 A * 4/1959 ..... A63B 69/16
FR 2636587 A1 * 3/1990 ..... B25H 1/0014
WO WO 9423807 A1 * 10/1994 ..... A63B 22/16

* cited by examiner

ROLLER TABLE HAVING A FOLDING STRUCTURE

OBJECT OF THE INVENTION

The invention, as expressed in the title of the present specification, relates to a roller assembly with folding structure which contributes, to the purpose for which it is intended, advantages and novelty characteristics that are described in detail later in the text and which represent a significant improvement over the current state of the art.

In particular, the object of the invention consists of a roller assembly, of the type intended for incorporating a bicycle to the rollers thereof in order to ride and train without moving forward, having the innovative peculiarity of consisting of a folded structure that is extremely simple and easy to assemble which, among other advantages, offers that of allowing the practical transport and storage thereof, thus occupying a minimum amount of space.

FIELD OF APPLICATION OF THE INVENTION

The field of application of the present invention falls within the industrial sector dedicated to the manufacture of sports accessories, focusing specifically on the sphere of bicycle rollers.

BACKGROUND OF THE INVENTION

In reference to the current state of the art, it should be noted that, although the existence of bicycle training rollers is known, at least by the applicant, the existence of training rollers having technical, structural and constituent characteristics similar to those advocated herein is unknown, as the roller assemblies of the state of the art generally consist of fixed and cumbersome structures that are not folding and, therefore, are difficult to transport, in addition to occupying a large amount of space, as they must be at least equivalent in length to the bicycle, making it unfeasible in many cases for users to acquire such a training element unless they have sufficient space.

Also, another drawback of current fixed roller assemblies is the high marketing cost thereof, precisely due to their size, because they either require greater space for storage and transport or require more time for installation and assembly. Therefore, the objective of the present invention is to provide the market with a new type of roller assembly which, while avoiding the aforementioned drawbacks, allows greater dissemination of this type of recreation element so that any user may have one.

EXPLANATION OF THE INVENTION

Therefore, the roller assembly with folding structure proposed by the present invention is configured as a significant novelty within its field of application as, in light of its implementation, the aforementioned objectives are satisfactorily achieved. The characterising details that distinguish it are adequately set out in the final claims that accompany this specification.

Specifically, the invention proposes a roller assembly which, in a characterising manner, consists of a simple folding structure to which rollers are coupled. This structure, made preferably of plastic, consists of a one-piece construction formed from the articulated joint between a plurality of straight sections coupled therebetween in such a manner as to, in a use position, form a rectangle whereon the rollers are mounted, as described below, and, in a folded position, form an elongated and compact block the length of which is slightly longer than that of the minor sides of said rectangle.

It should also be noted that folding and assembly of the structure is achieved through three simple movements, in such a manner that, as of the assembled rectangle, the structure firstly folds back upon itself, along its minor central axis, so as to adopt a U shape composed of two overlapping groups of three straight sections which, in second and third movements, are folded in a zig-zap fold along their respective articulated joints, which are advantageously structured so as to allow an angle of rotation of up to 270°, in such a manner that all the sections are grouped together and parallel therebetween, forming the aforementioned elongated block. Logically, in order to assemble the roller assembly the same steps must be followed but in reverse order and, once the rectangle is formed, the rollers are simply incorporated thereto.

Owing to their design, the articulated joints, which allow an angle of rotation of up to 270°, achieve extreme rigidity without need for additional dampers when the roller assembly is deployed.

In order to carry out said assembly, recesses with nipples have been envisaged in which the ends are inserted, distributed over strategic points, to dispose one or more rollers. Preferably, two rollers will be disposed on the rear of the structure, intended for positioning the rear wheel of the bicycle thereon, and one roller on the front part for the front wheel, having envisaged additional recesses on said front part for the purpose of choosing the size of said roller in accordance with the size of the bicycle.

Lastly, it should be mentioned that the existence of several rubber pegs (of the polymer type) have been envisaged on the lower part of the structure, in the use position thereof, to provide non-slip grip of the structure to the floor, avoiding possible movement due to the vibration caused when using it, and absorption of the vibration caused by the activity.

In light of the foregoing, the advantages of the proposed roller assembly are evident and can be summarised in the following points:

- It is a folding structure and its folding method allows storage of the roller assembly in just three movements.
- Assembly thereof, on being a one-piece construction, does not require assembly or screwing of parts or coupling thereof or the use of any type of tool, only deployment of the structure and incorporation of the rollers.
- The structure does not include loose parts and is composed of only has six sections which are articulated and joined together.
- On being a one-piece construction it is more secure as there is no risk of any part becoming separated therefrom.
- It is lightweight as, apart from being made of plastic, the constituent sections have been hollowed out to lighten its weight and, in turn, have ribs that reinforce it due to the design adopted based on rods disposed in a triangular layout with fixed articulation.
- It also enables the possibility of practicing other sports in addition to cycling, as different roller systems can be coupled thereto, as well as belts constituting a treadmill in order to, for example, walk or run.
- Likewise, it enables the possibility of coupling an electronic device thereto to generate electricity by converting energy created by body movement when training.
- The structure may have additional uses such as, for example, a base for the construction of a folding table.

On occupying a minimum amount of space when folded, it can be easily transported y one person, allows the user to practice sport anywhere without risk and stored when not used, allowing the space to be leveraged for other uses.

It can be used with different types of bicycles, such as road, mountain and others and, as the distance between rollers can be configured, it can also be used with bicycles of different sizes.

The bicycle is not fixed to any support while training, due to which the practice of the sport is not altered.

Optionally, an electronic device for measuring speed may be coupled thereto, which in turn allows said device to be connected online in order to compete with other users, allowing the creation of online games, It is rustproof, due to its plastic and rust-resistant materials, which allows use of the roller assembly both indoors and outdoors, regardless of weather conditions.

In light of the foregoing, it is evident that the roller assembly with folding structure described represents an innovative structure of structural and constituent characteristics that do not exist in the state of the art for its intended purpose. Said reasons, added to the practical utility thereof, are sufficient to be granted the exclusive privilege being requested.

DESCRIPTION OF THE DRAWINGS

For the purpose of complementing this description and helping to better understand the characteristics of the substrate of the invention, a set of drawings is attached to this specification as an integral part thereof, wherein the following has been represented in an illustrative and non-limiting manner:

FIGS. 3 and 4 are top plan views of the first two folding phases of the structure, and FIG. 5 is an elevational view of the structure completely folded and represented next to the rollers that are coupled thereto for use thereof.

PREFERRED EMBODIMENT OF THE INVENTION

In light of the aforementioned figures, and in accordance with the numbering adopted, a preferred embodiment of the roller assembly with folding structure object of the invention is represented, comprising the parts and elements indicated and described in detail below.

Figure 1:
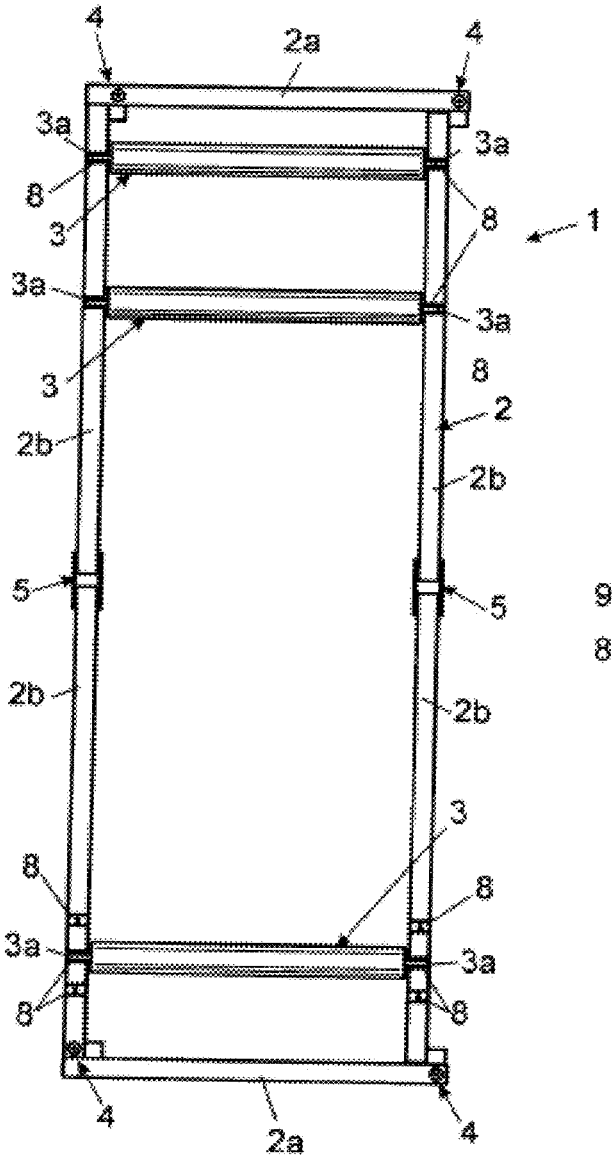
FIG. 1 shows a top plan view of an embodiment of the roller assembly with folding structure object of the invention, represented in its use position.
Figure 6:
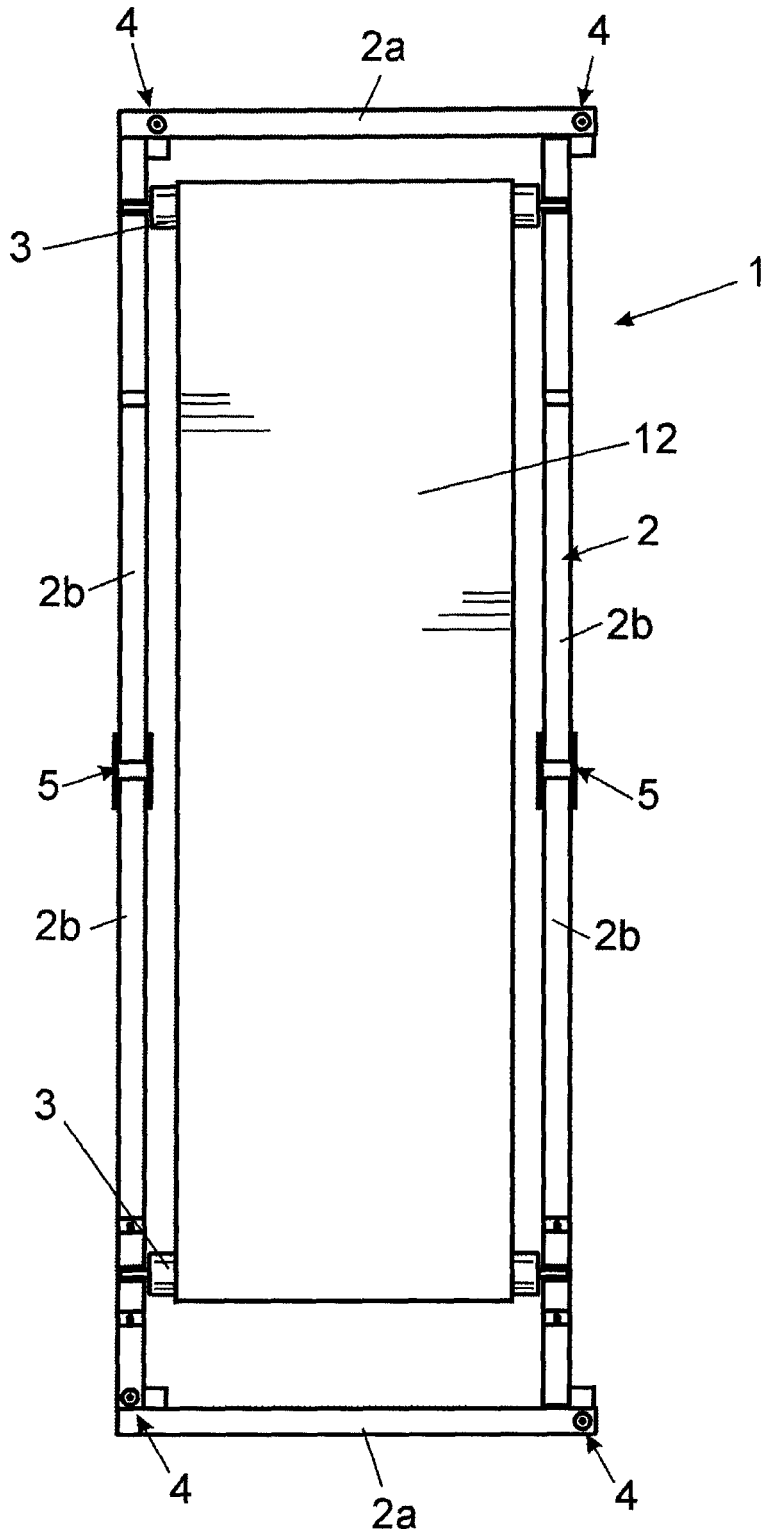
FIG. 6 shows another top plan view of the roller assembly assembled, in this case, in this case incorporating a treadmill.

Therefore, based on the top plan view shown in FIG. 1, the frame (1) in question is configured from a structure (2) whereto at least three rollers (3) are coupled which, resting on their respective ends, rotate freely, in such a manner that a bicycle (not shown) can be ridden thereon or, by adding a treadmill (12) (see FIG. 6), it can be used to walk or run.

This structure (2) is folding and, in its use position (FIG. 1) has a rectangular frame shape which can be completely folded to form, in its folded position (FIG. 5), an elongated and flat compact block which, logically, occupies much less space.

The structure (2) consists of an articulated one-piece construction formed of a plurality of straight sections (2*a*, 2*b*) joined together which, preferably, comprise two transverse sections (2*a*) corresponding to the minor sides of the rectangular frame, and four longitudinal sections (2) corresponding to the respective halves of the major sides of said rectangular frame.

All of these sections are coupled therebetween by means of articulated joints that rotate around a vertical axis (4) and, therefore, movement of the sections is along a horizontal plane; and hinged joints that rotate around a horizontal axis (5) and, consequently, movement of the sections along a vertical plane; comprising, in each of the joints between the transverse (2*a*) and longitudinal (2*b*) sections that determine the four corners of the rectangular frame, an articulated joint that rotates a vertical axis (4) which allows an angle of rotation between said sections of up to 270°; and, in the two joints between longitudinal sections (2*b*) that determine the two halves of the major sides of the rectangular frame, a hinged joint that rotates around a horizontal axis (5) which allows an angle of rotation of up to 180° between said sections.

Figure 2:
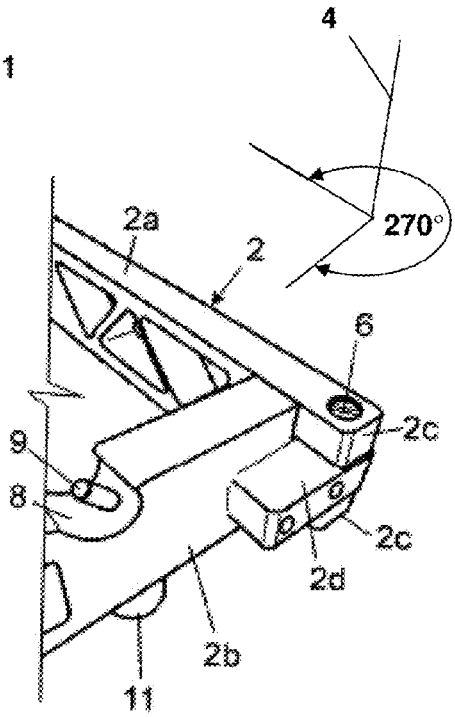
FIG. 2 shows a perspective view of the detail of one of the articulated corners of the structure, in which the configuration of the articulated joint with an angle of rotation of 270° can be observed.

More specifically, the articulated joints that rotate around a vertical axis (4) with an angle of rotation of 270°, as can be observed in the detail of FIG. 2, comprise a screw (6) which acts as a vertical axis that penetrates the respective ends of the sections (2*a* and 2*b*) to be joined together, which are interconnected in such a manner that one of said sections has an inverted U-shaped cavity that determines two tips (2*c*) at the end of the section that protrude slightly beyond the point of intersection with the other section to be joined, while this other section, in turn, has a tip (2*d*) that protrudes frontally and laterally from the centre of the end of the section itself and is fitted by coupling to said U-shaped cavity between the two tips (2*c*).

For their part, the hinged joints that rotate horizontally (5) between longitudinal sections (2*b*) that determine the two halves of the major sides of the rectangular frame are carried out by means of corresponding strips (7) joined together and, on either side thereof, the respective ends of each of said sections (2*b*).

Figure 3:
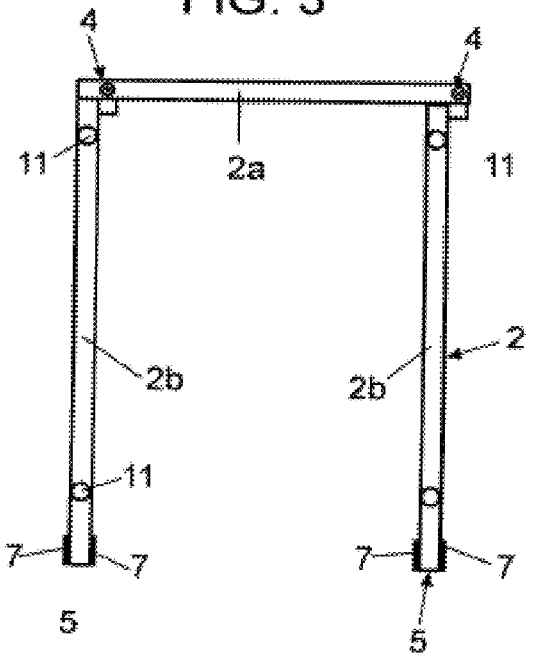
FIGS. 3, 4 and 5 show different views of the structure of the roller assembly of the invention in its three folding phases, where
Figure 4:
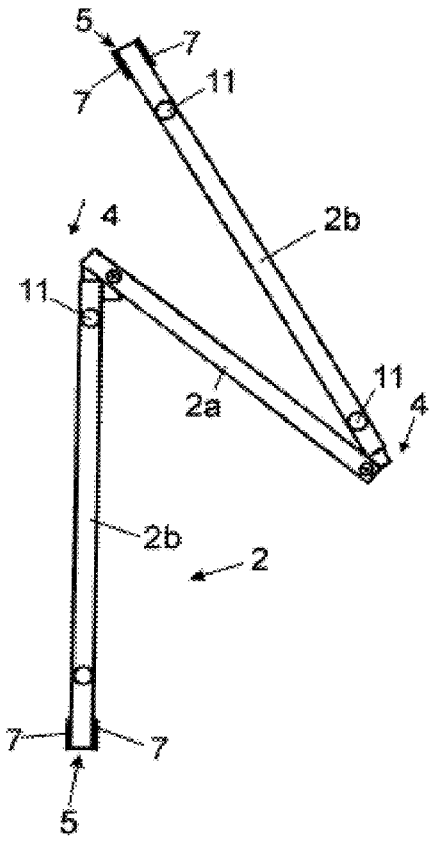

Consequently, the structure (2) is folded and unfolded in just three movements, in such a manner that, as of the rectangular frame that it forms in its use position, to fold the structure it must firstly be folded back upon itself along the hinged joints that rotate horizontally (5) disposed coincident with the minor central axis of said frame, whereupon the structure adopts a U-shaped configuration where the transverse sections (2*a*) and longitudinal sections (2*b*) overlap each other, as shown in FIG. 3.

Figure 5:
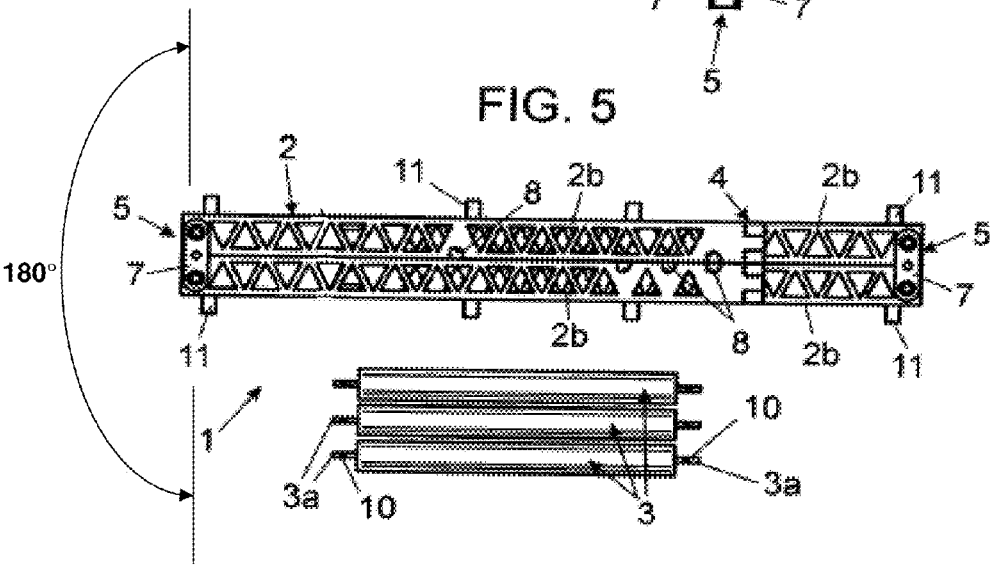

In second and third movements, the previously described assembly of U-shaped sections are folded in a zig-zag fold, i.e. in opposite directions, along the articulated joints that rotate around a vertical axis (4) that join them together, whereupon, as shown in FIG. 5, they are grouped together and parallel therebetween, forming the aforementioned elongated block.

In order to assemble the rollers, the existence of recesses (8) with protruding nipples (9) have been envisaged on the upper side of the longitudinal sections (2*b*) of the structure (2), suitable for being inserted into holes (10) made for such purpose on the ends (3*a*) of the roller (3) axis, envisaging the sufficient number thereof to dispose, at least, two rollers on the rear part thereof and one roller on the front part thereof. Also, more recesses (8) than required to fix the three rollers (3) have been envisaged, thus allowing variation in the position of, at least, one of said rollers (3) in order to adapt the separation therebetween to different bicycle sizes.

Lastly, the existence of dampers (11) made of rubber or similar anti-slip material has been envisaged on the lower part of the structure (2) in order to avoid possible movements and/or noises caused by the vibration and movement on using the roller assembly.

Also, in all the figures it can be observed how the structure (2), which is preferably made of plastic material, has been hollowed out and has reinforcement rib, which lighten the weight of the structure and reinforce it, respectively.

Having sufficiently described the nature of the present invention, as well as the manner in which to practice it, it is not deemed necessary to provide further explain for any person skilled in the art to understand its scope and the advantages arising therefrom, stating that, within its essentiality, it may be practiced in other embodiments that differ in detail from that indicated by way of example, and which would also be included in scope of protection being requested, provided that the basic principle thereof is not altered, changed or modified.

The invention claimed is:

1. A roller assembly with folding structure that is configured from a structure to which one or more rollers are coupled, the one or more rollers comprising respective ends for resting on the structure, rotate freely, in such a manner adapted for a user to ride a bicycle thereon, or by adding a treadmill on the structure, adapted for the user to walk or run thereon, is characterised in that the structure comprises an articulated one-piece construction, which is formed from a plurality of transverse sections and longitudinal sections joined together by articulated joints that rotate around a vertical axis such that movement of the plurality of transverse sections and longitudinal sections are on a horizontal plane, and hinged joints that rotate around a horizontal axis such that movement of the plurality of transverse sections and longitudinal sections are on the vertical plane; and in that said structure when in a use position, is unfolded and is configured as a rectangular frame, while in a folded position forms an elongated and flat compact block, wherein on an upper part of the structure further comprises recesses having protruding nipples, the protruding nipples configured for being inserted into holes on ends of a roller axis of one of the one or more rollers.

2. The roller assembly with folding structure, according to claim 1, characterised in that the plurality of transverse sections and longitudinal sections are two transverse sections, corresponding to minor sides of the rectangular frame, and four longitudinal sections corresponding to respective halves of major sides of said rectangular frame, the rectangular frame comprising four corners formed between transverse and longitudinal sections, wherein each corner comprises an articulated joint of the articulated joints, each articulated joint that rotates around a vertical axis allows an angle of rotation between said longitudinal sections of up to 270°; and the hinged joints are two joints, each of the two joints is between the longitudinal sections that determine the two halves of the major sides of the rectangular frame, each of the hinged joint rotates around a horizontal axis which allows an angle of rotation of up to 180° between said longitudinal sections.

3. The roller assembly with folding structure, according to claim 2, characterised in that the articulated joints that rotate around a vertical axis with an angle of rotation of 270°, comprise a screw that acts as the vertical axis and penetrates respective interconnected ends of the transverse sections and the longitudinal sections to be joined together.

4. The roller assembly with folding structure, according to claim 3, characterised in that the hinged joints that rotate around a horizontal axis between longitudinal sections that determine the two halves of the major sides of the rectangular frame are carried out by corresponding strips that join together each of said longitudinal sections.

5. The roller assembly with folding structure, according to claim 1, further comprising dampers made of anti-slip material on a lower part of the structure.

6. The roller assembly with folding structure, according to claim 1, characterised in that the structure, from the use position configured as of the rectangular frame, is susceptible to being folded in half and then back upon itself, along a minor central axis, in a U shape and in a zig-zag fold to form the elongated and flat compact block that constitutes the folded position thereof.

7. The roller assembly with folding structure, according to claim 1, characterised in that the structure has up to ten recesses suitable to fix one of the one or more rollers, allowing variation of the position of, at least, one of the one or more rollers to adapt the separation therebetween to different bicycle sizes.

* * * * *